US006619861B2

(12) United States Patent
Twist et al.

(10) Patent No.: US 6,619,861 B2
(45) Date of Patent: Sep. 16, 2003

(54) PROCESSING PHOTOGRAPHIC MATERIAL

(75) Inventors: Peter J. Twist, Great Missenden (GB); Leslie Wells, Bounds Green (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/134,324

(22) Filed: Apr. 29, 2002

(65) Prior Publication Data

US 2002/0181959 A1 Dec. 5, 2002

(30) Foreign Application Priority Data

May 4, 2001 (GB) ..... 0110923

(51) Int. Cl.[7] ..... G03D 3/04; G03D 13/00

(52) U.S. Cl. ..... 395/571; 396/635

(58) Field of Search ..... 396/573, 625, 396/626, 633–636, 571, 572; 355/27–29

(56) References Cited

U.S. PATENT DOCUMENTS

| | | | | |
|---|---|---|---|---|
| 3,856,395 A | | 12/1974 | Comstock | 396/636 |
| 4,030,115 A | | 6/1977 | Perriniaux | 396/573 |
| 4,054,902 A | * | 10/1977 | Rebek | 396/573 |
| 4,206,993 A | | 6/1980 | Csepke | 396/635 |
| 4,634,251 A | | 1/1987 | Jonker | 396/573 |
| 6,322,261 B1 | * | 11/2001 | Kuzyk | 396/625 |

* cited by examiner

*Primary Examiner*—D Rutledge
(74) *Attorney, Agent, or Firm*—Frank Pincelli

(57) ABSTRACT

An apparatus for processing photographic material has a chamber which is manufactured such that temperature uniformity is maintained across the chamber.

12 Claims, 4 Drawing Sheets

PROCESSING PHOTOGRAPHIC MATERIAL

CROSS REFERENCE TO RELATED APPLICATIONS

This is a U.S. original patent application which claims priority on Great Britain patent application No. 0110923.0 filed May 4, 2001.

FIELD OF THE INVENTION

This invention relates to a processing apparatus for processing photographic material. In particular, the invention relates to a processor in which the entire process is carried out in a single processing space.

BACKGROUND OF THE INVENTION

Co-pending U.S. application Ser. No. 09/920,495 discloses a processor which consists of a rotating cylindrical drum operating as a single-use processing apparatus in which the entire process is carried out in the same vessel. A convenient method of heating the drum is by means of a hot air box. Other heating methods such as a water thermostat through which the lower part of the drum passes can also be used. Surface mounted heaters can also be used. In conventional processing machines having tanks containing the processing solutions the tanks are often made of a plastics material such as PVC. This is ideal because it is inert to processing chemicals and has low thermal conductivity. Thus an aqueous solution can be heated in a tank by means of an immersible cartridge heater. Tank volumes are usually of the order of a few liters and good temperature control can be achieved because PVC is a good insulator. A single use processing machine as disclosed in, for example, co-pending application Ser. No. 09/920,495, uses similar volumes to process film as those used to replenish large conventional tanks of the order of 6 ml/linear foot of 35 mm film. This means that a 36 exposure film is developed in a volume of about 30 ml. This is about a factor of 100 lower than a conventional tank. The problem to be solved for a single use device is that the volume of solution used for processing is small but the apparatus to hold the film and to contain the solution is relatively large. Thus a small volume of processing solution which is pre-heated to the desired temperature is spread over the film and the inner surface of the processing chamber. The processing chamber is also pre-heated to the desired temperature but because of the complex structure of the processing chamber, temperature non-uniformities can occur within it. These are transferred to the film and to the processing solution. This results in image non-uniformities which can be manifest as unwanted non-imagewise density changes over the film area.

SUMMARY OF THE INVENTION

The invention aims to solve the problems mentioned above by removing the temperature non-uniformities.

According to the present invention there is provided an apparatus for processing a photographic material comprising a chamber adapted to hold the material therein, means for introducing solution into the chamber, means for removing the solution from the chamber and means for rotating the chamber, wherein the chamber is made of a material having a thermal conductivity greater than $1.47\times10^{-3}$ Watt/cm/degree K.

The invention further provides an apparatus for processing a photographic material comprising a chamber adapted to hold the material therein, means for introducing solution into the chamber, means for removing the solution from the chamber and means for rotating the chamber, wherein the cross-section of the wall of the chamber is such that overall uniformity of temperature is maintained across the chamber.

The invention yet further provides an apparatus for processing a photographic material comprising a chamber adapted to hold the material therein, means for introducing solution into the chamber, means for removing the solution from the chamber and means for rotating the chamber, wherein the cross-section of the wall of the chamber is substantially uniform throughout.

The invention also provides a method of heating a processing chamber to an operating temperature, the chamber being located within an insulated housing, the method comprising the steps of heating the air within the insulated housing, directing the heated air in a direction away from the chamber, circulating the heated air throughout the housing and rotating the chamber within the heated air, the chamber thus being heated to a uniform temperature throughout.

Overall temperature control of the processing device can be improved by the invention.

The invention improves temperature uniformity throughout the processing space.

The invention improves the uniformity of processing conducted within the processing space.

BRIEF DESCRIPTION OF THE DRAWINGS

The invention will now be described, by way of example, with reference to the accompanying drawings, in which.

DETAILED DESCRIPTION OF THE INVENTION

As described earlier, a single use processing machine as disclosed in, for example, co-pending U.S. application Ser. No. 09/920,495, can process a color negative film in a volume which is the same as that used to replenish large tanks in conventional processing machines. The development stage can be carried out in 6 ml/linear foot (of 35 mm film). This means that a 36 exposure 35 mm film is developed in 30 ml of solution. In order to maintain good temperature control the processing solution is pre-heated and in order to maintain this temperature the film holding chamber must be heated to the same temperature. This is difficult to achieve in a uniform manner if the material of the processing chamber is of a low conductivity material such as PVC. This is particularly true if the PVC material is of different thickness in different regions of the drum. This is even more true if the drum is heated by hot air which has a low heat capacity and has a very long equilibration time with a low conductivity material such as PVC. PVC has a thermal conductivity of about $1.47\times10^{-3}$ Watt/cm/degree K. This means that regions of different temperature take a long time to be removed. In addition, in the single space processor described it has been found that some cooling of the solution in the processing chamber occurs because of evaporation. This can occur in the same sort of time as the processing time and will not be uniform across the film width. If this results in temperature non-uniformities across the film these will be slow to be removed or counteracted if the solution is in contact with a low conductivity material such as PVC. Such temperature non-uniformities will result in unwanted non-uniformities in the image.

Figure 1B:
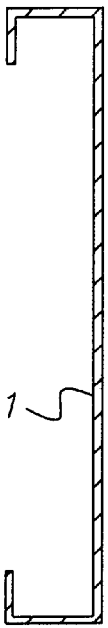
FIG. 1 is a schematic side view of a processor in accordance with the present invention.
Figure 1A:
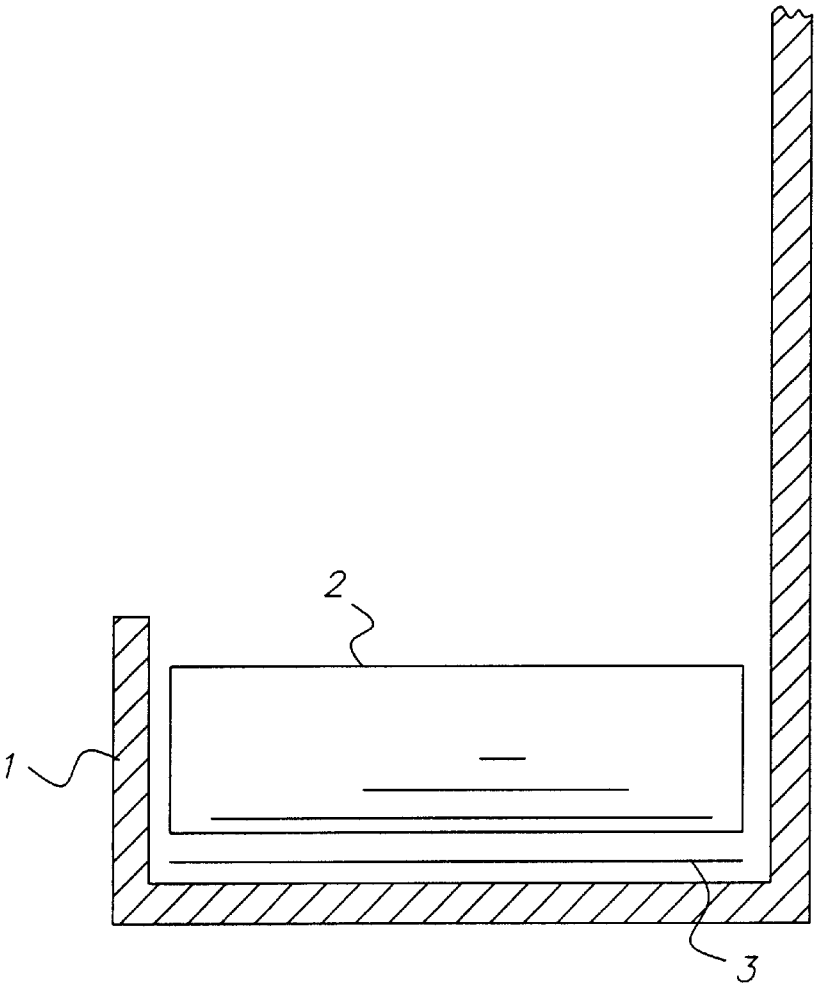

A processor according to the invention has a processing chamber made of a material which is of a high conductivity greater than $1.47\times10^{-3}$ Watt/cm/degree K. Suitable common metals and their thermal conductivities are as follows aluminum=2.36 Watt/cm/degree K, copper 3.83 Watt/cm/degree K, iron=0.76 Watt/cm/degree K. These are of the order of a thousand times that of PVC. Another suitable material would be borosilicate glass, having a conductivity of $1.2\times10^{-2}$ Watt/cm/degree K. This is about ten times that of PVC. Carbon fiber could also be used. By making the processing chamber or drum of a high conductivity material the temperature non-uniformities are removed. FIG. 1 is a schematic side view of a processor in accordance with the present invention.

The drum processor 1 is in the form of a flat cylinder. Film 3 is fed into the cylinder and lies around the inner circumference thereof. The width of the cylinder is sufficient to accommodate a film of width 35 mm. The circumference of the processor is slightly greater than the length of a 36 exposure film (about 153 cm). A roller 2 may be provided at the lower part of the cylinder to agitate the processing solution.

Full details of such a single space processor can be found in co-pending U.S. application Ser. No. 09/920,495, the contents of which are herein incorporated. The drum chamber as illustrated in FIG. 1 shows the cross-section being of as nearly uniform thickness as possible. The heating and cooling times in the different regions of the drum will therefore be more uniform. It is also possible to design the drum chamber specifically to minimize the presence of hot and cold regions.

A further method of achieving the aim of the invention is to heat the processing chamber in such a way as to minimize the generation of temperature non uniformities within the chamber.

If the heating method is by means of hot air then the airflow from the heater should be directed uniformly at all regions of the drum. If the drum is of a complex shape this is difficult to achieve. The processing chamber disclosed in co-pending U.S. application Ser. No. 09/920,495, is of a flat cylindrical shape. The depth of the cylinder is about the same but slightly more than the film width (35 mm) whereas the circumference is about the same as the length of a 36 exposure film (about 153 cm). Thus there is a small cross section across the depth and a large cross section across the width.

Figure 2:
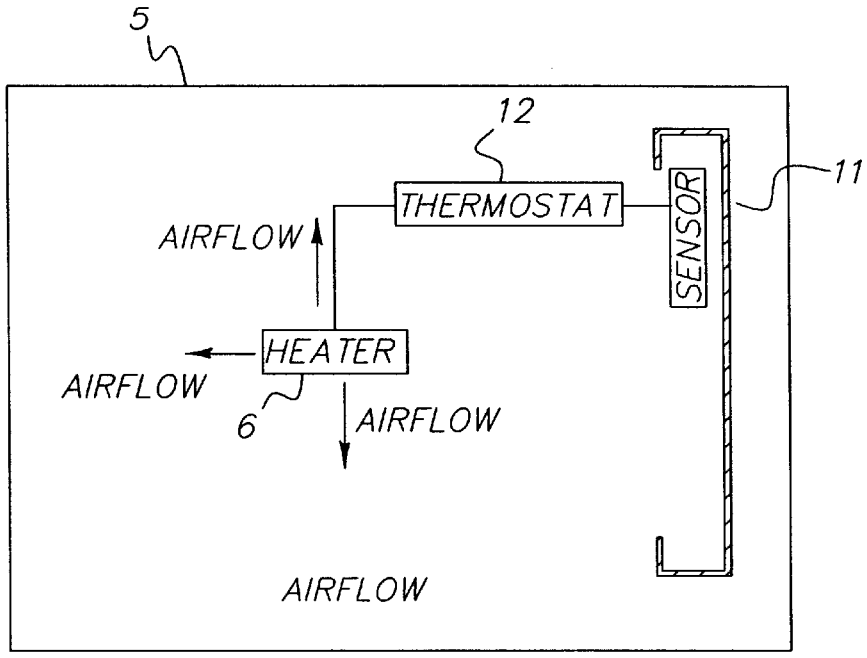
FIG. 2 is a schematic view of an arrangement in which a processor is heated in accordance with the present invention.

In accordance with the invention the airflow is directed so as to uniformly heat these different cross sections. One simple way to do this is to ensure that there is no strong airflow directed at the processing chamber but that the chamber rotates in air that is maintained at the desired temperature. FIG. 2 is a schematic side view of a processor heated in this way.

Figure 3:
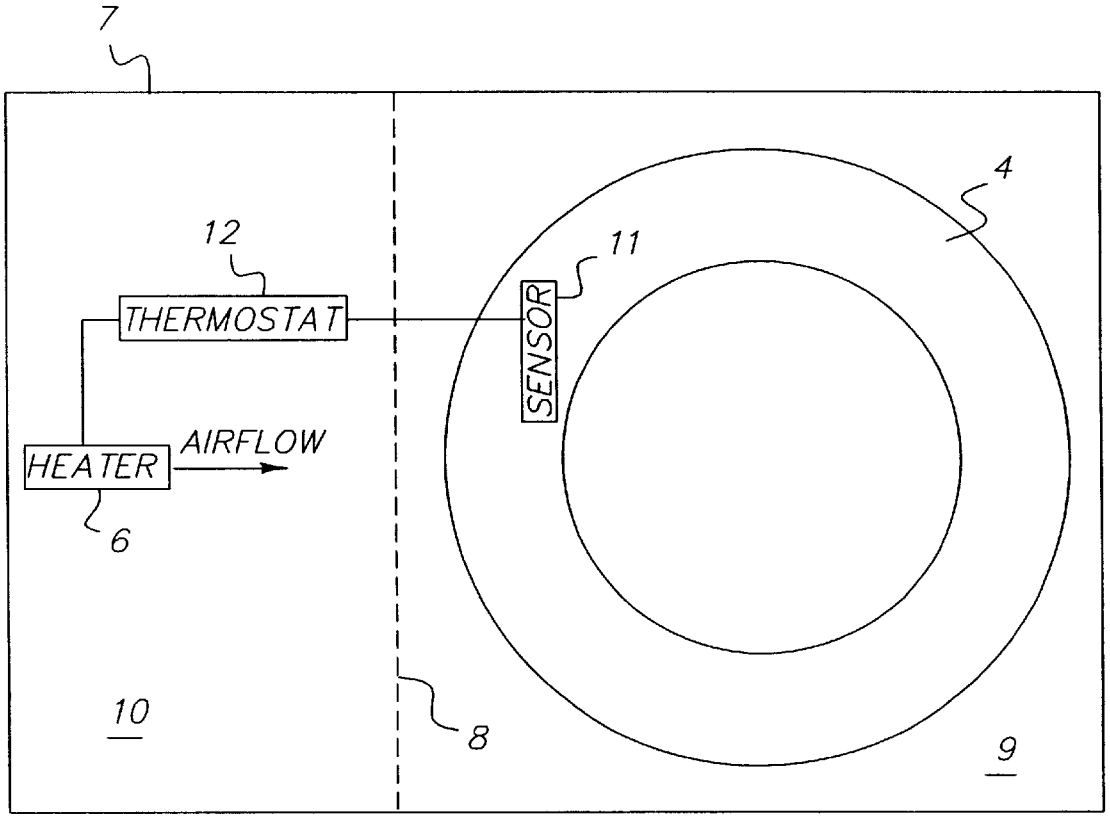
FIG. 3 is a schematic view of an arrangement in which a processor is heated in accordance with the present invention.

FIG. 2 shows a rotating drum processor 4 defining a processing chamber. The processor is located within an insulated box 5. Also located within the insulated box 5 is a heater and fan 6. Air is heated and the heated airflow is directed away from the processing chamber and circulated by means of the fan 6. Thus the air within the insulated box should be of a uniform temperature throughout. This will ensure that there are no temperature non-uniformities within the processing chamber and the film may be processed evenly. A temperature sensor 11 may be located within the drum processor. The sensor 11 is connected to an adjustable thermostat 12. The thermostat 12 is connected to the heater 6. The heater can thus be switched on or off to maintain the correct temperature in the rotating drum. FIG. 3 is a schematic front view of a processor heated such that the different cross sections thereof are heated uniformly.

FIG. 3 shows a rotating drum processor 4 defining a processing chamber. The processor is located within an insulated box 7. The insulated box 7 is divided into two sections, separated by a baffle arrangement 8. The processor 4 is located within one section 9 and a heater and fan 6 is located within the other section 10. Air within section 9 of the insulated box 7 is heated by the heater to the desired temperature. The heated air is then fed by recirculation from section 9 of the box into section 10. The drum thus rotates in air of a uniform temperature and the film therein may be processed evenly. A temperature sensor 11 and adjustable thermostat 12 may be provided as described with respect to FIG. 2.

A third more complex way to achieve temperature uniformity in the processing chamber is to design a close fitting cover for the processing chamber which directs a uniform airflow over all surfaces of the chamber.

It is clear that all these methods of preventing temperature non-uniformities is facilitated by a processing chamber or drum which is made of a material of high thermal conductivity. The drum can also be heated by other means such as a heating pad attached to the outside of the drum or by passing the lower part of the drum through a temperature controlled water bath or by electrical induction if the drum is of a metal construction.

EXAMPLES

A pair of single use photographic processing chambers, one made of polyvinylchloride (PVC) and one made of aluminum, were compared for their ability to maintain the temperature uniformity of a small volume of solution. Single use processing is defined as the use of a small volume of processing solution to carry out a stage or stages of a process after which the volume is discarded. The small volume used is of the same order as the replenishment volume used to process the same film in conventional deep tank processors. The small volume is in the range of 2 ml to 12 ml per linear foot of 35 mm color negative film for a given stage of the process. The processing chamber is of a flat cylindrical shape with a depth of about 35 mm and a diameter of 508 mm. Photographic film can be loaded around the inner circumference of the drum and processed with the small volume of solution. The drum chamber is located within an airbox thermostat so that it is maintained at a desired temperature. The drum is rotated during the warm up period and during the processing cycles.

Example 1

Figure 4:
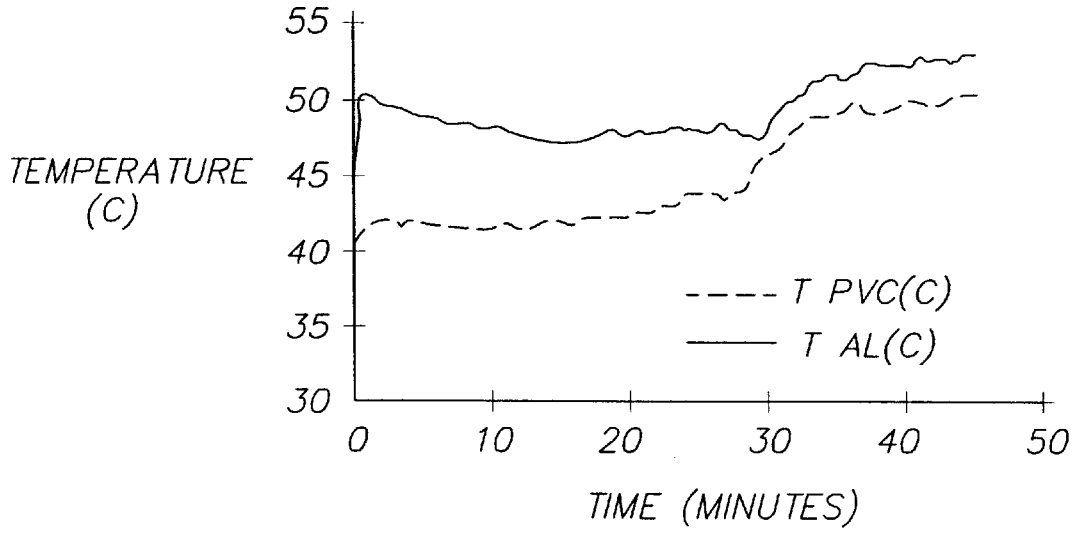
FIG. 4 is a graph illustrating the results obtained in a first experiment.

In this example the two drums were left to warm for 1.5 hours with the airbox thermostat set at 55° C. Then 30 ml of water at 23° C. was introduced into the drum chamber. A thermocouple probe monitored the temperature of the water which was recorded as a function of time. The plot in FIG. 4 shows the temperature profile of the two drums.

The lower curve is for the PVC drum and the upper curve for the aluminum drum. It is clear that the water in the aluminum drum remains at a higher temperature than the PVC drum until all of the water has evaporated. It is surprising that the water never reaches the set temperature of the airbox thermostat (55° C.) in either drum but it is always higher in the aluminum drum. It is also surprising that even though both the drums are at 55° C. before the water is added this temperature is never recovered.

Example 2

In this example the drums were left to heat for 1.5 hours in the thermostat box which was set to 55° C. 30 ml of water which had been pre-heated to 55° C. was added to the drum and the temperature of the water was monitored as a function of time. The result for the two drums is shown in FIG. 5.

Figure 5:
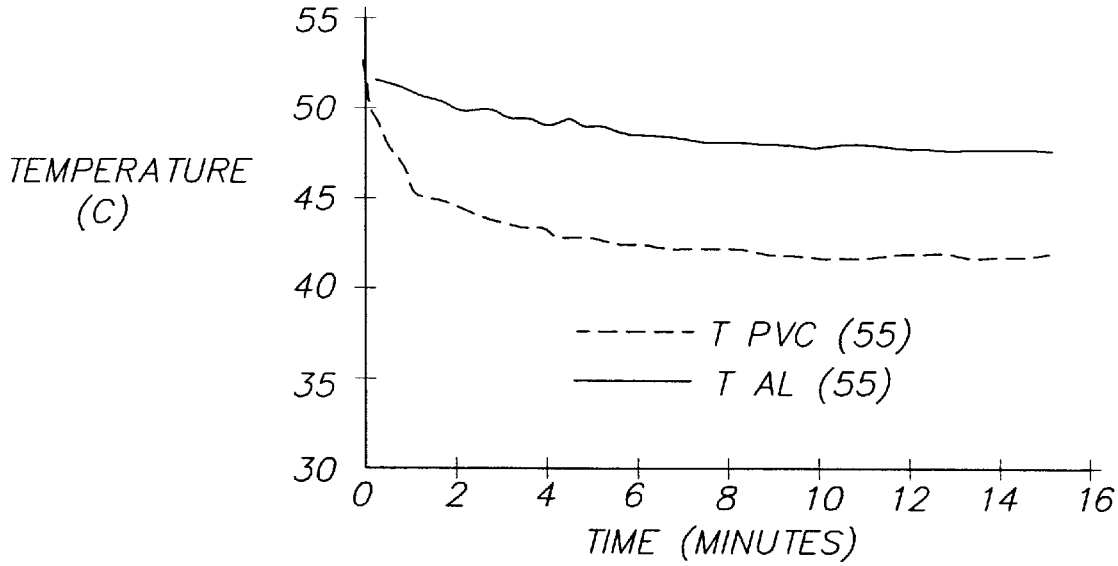
FIG. 5 is a graph illustrating the results obtained in a second experiment.

In FIG. 5 it can be seen that even when both the drum and the water start at 55° C. the temperature unexpectedly drops and eventually levels-off below 55° C. The temperature drops much faster and much further in the PVC drum than the aluminum drum. This illustrates an unexpected and surprising result and demonstrates that a processing chamber made of a higher conductivity material is better able to maintain a water volume at a uniform temperature than a lower conductivity material even though the starting temperature of the chamber and the starting temperature of the water was the same for both processing chambers.

Example 3

The processing chamber used in all these examples is a single chamber in which the entire photographic process is carried out. Processing solutions can be added and removed from the chamber in any order needed for a process cycle. Solutions can also be mixed together by adding one processing solution on top of another processing solution. Part of a processing solution volume can be removed and part can be retained for further processing. In this example water was added in two stages to simulate the first and second stages in a photographic process. The drums were left to heat to 55° C. for 1.5 hours in the airbox set to 55° C. Then 30 ml of water pre-heated to 55° C. was added to the drum and its temperature was monitored as a function of time. After 1 minute a second amount of water (20 ml) pre-heated to 55° C. was added and its temperature was monitored. The result is shown in FIG. 6.

Figure 6:
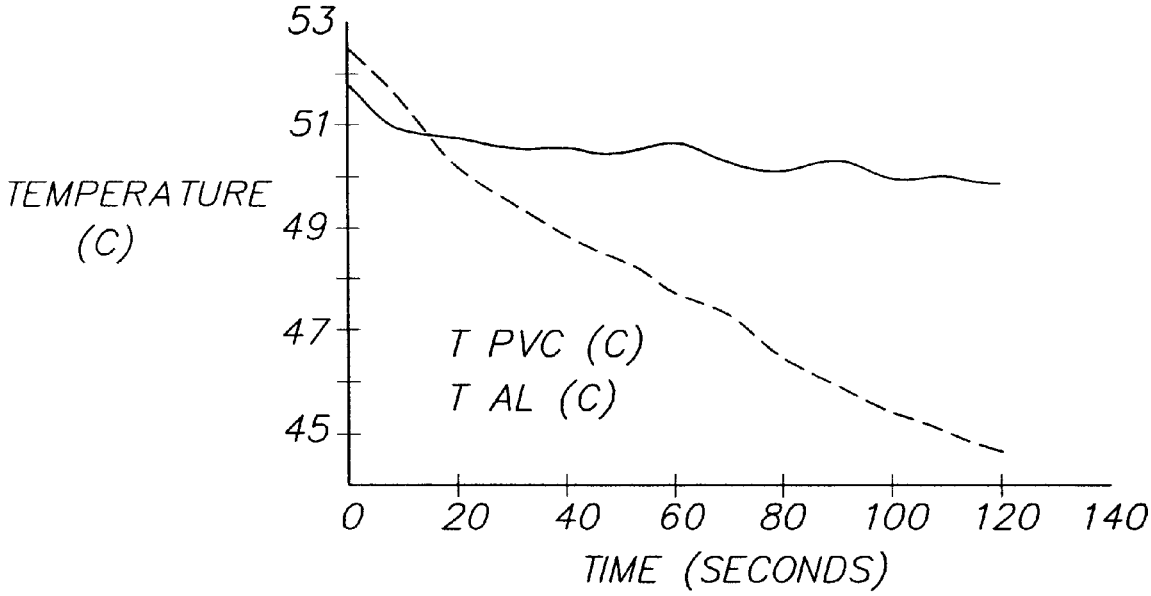
FIG. 6 is a graph illustrating the results obtained in a third experiment.

It is clear from the data in FIG. 6 that even with a second addition of water at 60 seconds the water in the PVC drum continues to fall in temperature whereas the aluminum drum falls in the first few seconds but then levels off.

The invention has been described in detail with reference to preferred embodiments thereof. It will be understood by those skilled in the art that variations and modifications can be effected within the scope of the invention.

| PARTS LIST | |
|---|---|
| 1. | drum processor |
| 2. | roller |
| 3. | film |
| 4. | drum processor |
| 5. | insulated box |
| 6. | heater and fan |
| 7. | insulated box |
| 8. | baffle arrangement |
| 9. | section of box |
| 10. | section of box |
| 11. | temperature sensor |
| 12. | adjustable thermostat |

What is claimed is:

1. Apparatus for processing a photographic material comprising a chamber adapted to hold the material therein, means for introducing solution into the chamber, means for removing the solution from the chamber and means for rotating the chamber, the chamber being made of a material having a thermal conductivity greater than $1.47\times10^{-3}$ Watt/cm/degree K and the cross-section of the wall of the chamber is such that uniformity of temperature is maintained across the chamber.

2. Apparatus for processing a photographic material comprising a chamber adapted to hold the material therein, means for introducing solution into the chamber, means for removing the solution from the chamber and means for rotating the chamber, the chamber being made of a material having a thermal conductivity greater than $1.47\times10^{-3}$ Watt/cm/degree K and the cross-section of the wall of the chamber being substantially uniform throughout.

3. Apparatus for processing a photographic material comprising a chamber adapted to hold the material therein, means for introducing solution into the chamber, means for removing the solution from the chamber and means for rotating the chamber, wherein the cross-section of the wall of the chamber is such that overall uniformity of temperature is maintained across the chamber.

4. Apparatus as claimed in claim 3 wherein a temperature sensor is located within the chamber, the sensor being in connection with thermostatic control means.

5. Apparatus for processing a photographic material comprising a chamber adapted to hold the material therein, means for introducing solution into the chamber, means for removing the solution from the chamber and means for rotating the chamber, wherein the cross-section of the wall of the chamber is substantially uniform throughout.

6. Apparatus as claimed in claim 5 wherein a temperature sensor is located within the chamber, the sensor being in connection with thermostatic control means.

7. A method of heating a processing chamber to an operating temperature, the chamber being located within an insulated housing, the method comprising the steps of heating the air within the insulated housing, directing the heated air in a direction away from the chamber, circulating the heated air throughout the housing and rotating the chamber within the heated air, the chamber thus being heated to a uniform temperature throughout.

8. A method as claimed in claim 7 wherein the chamber is made of a material having a thermal conductivity greater than $1.47\times10^{-3}$ Watt/cm/degree K.

9. A method as claimed in claim 7 wherein the wall of the chamber has a cross-section such that overall uniformity of temperature is maintained across the chamber.

10. A method as claimed in claim 7 wherein the cross-section of the wall of the chamber is substantially uniform throughout.

11. A method as claimed in claim 7 wherein the insulated housing is divided into two sections separated by a baffle arrangement, a first section housing the processing chamber and a second section housing means for heating and circulating the air.

12. A method as claimed in claim 7 wherein the heater is controlled by means of a thermostat, the thermostat receiving signals from a temperature sensor located within the chamber.

* * * * *